US006946962B2

(12) United States Patent
Leone

(10) Patent No.: US 6,946,962 B2
(45) Date of Patent: Sep. 20, 2005

(54) ELECTRONIC ARTICLE SURVEILLANCE MARKER DEACTIVATOR USING INDUCTIVE DISCHARGE

(75) Inventor: Steven V. Leone, Lake Worth, FL (US)

(73) Assignee: Sensormatic Electronics Corporation, Boca Raton, FL (US)

( * ) Notice: Subject to any disclaimer, the term of this patent is extended or adjusted under 35 U.S.C. 154(b) by 126 days.

(21) Appl. No.: 10/696,679

(22) Filed: Oct. 29, 2003

(65) Prior Publication Data

US 2005/0093699 A1 May 5, 2005

(51) Int. Cl.[7] ..... G08B 13/14
(52) U.S. Cl. ..... 340/572.3; 361/149; 307/109
(58) Field of Search ..... 340/572.3; 361/149; 307/109

(56) References Cited

U.S. PATENT DOCUMENTS

| | | | | |
|---|---|---|---|---|
| 4,617,603 A | | 10/1986 | Johnson et al. | 361/149 |
| 5,353,011 A | * | 10/1994 | Wheeler et al. | 340/572.4 |
| 5,493,275 A | | 2/1996 | Easter | 340/572 |
| 5,495,230 A | * | 2/1996 | Lian | 340/572.1 |
| 5,907,465 A | | 5/1999 | Easter | 361/149 |
| 6,002,335 A | * | 12/1999 | Zarembo et al. | 340/572.1 |
| 6,084,514 A | * | 7/2000 | Kopp et al. | 340/572.3 |
| 6,181,249 B1 | * | 1/2001 | Maitin et al. | 340/572.3 |
| 6,696,951 B2 | * | 2/2004 | Belka et al. | 340/572.1 |

* cited by examiner

*Primary Examiner*—Daniel Wu
*Assistant Examiner*—Samuel J. Walk

(57) ABSTRACT

A method and apparatus to deactivate an EAS security tag are described.

23 Claims, 4 Drawing Sheets

ELECTRONIC ARTICLE SURVEILLANCE MARKER DEACTIVATOR USING INDUCTIVE DISCHARGE

BACKGROUND

An Electronic Article Surveillance (EAS) system is designed to prevent unauthorized removal of an item from a controlled area. A typical EAS system may comprise a monitoring system and one or more security tags. The monitoring system may create an interrogation zone at an access point for the controlled area. A security tag may be fastened to an item, such as an article of clothing. If the tagged item enters the interrogation zone, an alarm may be triggered indicating unauthorized removal of the tagged item from the controlled area.

When a customer presents an article for payment at a checkout counter, a checkout clerk either removes the security tag from the article, or deactivates the security tag using a deactivation device. In the latter case, improvements in the deactivation device may facilitate the deactivation operation, thereby increasing convenience to both the customer and clerk. Consequently, there may be need for improvements in deactivating techniques in an EAS system.

BRIEF DESCRIPTION OF THE DRAWINGS

The subject matter regarded as the embodiments is particularly pointed out and distinctly claimed in the concluding portion of the specification. The embodiments, however, both as to organization and method of operation, together with objects, features, and advantages thereof, may best be understood by reference to the following detailed description when read with the accompanying drawings in which:

DETAILED DESCRIPTION

Numerous specific details may be set forth herein to provide a thorough understanding of the embodiments of the invention. It will be understood by those skilled in the art, however, that the embodiments of the invention may be practiced without these specific details. In other instances, well-known methods, procedures, components and circuits have not been described in detail so as not to obscure the embodiments of the invention. It can be appreciated that the specific structural and functional details disclosed herein may be representative and do not necessarily limit the scope of the invention.

It is worthy to note that any reference in the specification to "one embodiment" or "an embodiment" means that a particular feature, structure, or characteristic described in connection with the embodiment is included in at least one embodiment. The appearances of the phrase "in one embodiment" in various places in the specification are not necessarily all referring to the same embodiment.

One embodiment of the invention may be directed to a deactivator for an EAS system. The deactivator may be used to deactivate an EAS security tag using inductive discharge. The security tag may comprise, for example, an EAS marker encased within a hard or soft outer shell. The deactivator may create a magnetic field using inductive discharge of an energized coil to deactivate the marker. Once deactivated, the EAS security tag may pass through the interrogation zone without triggering an alarm. The deactivator may be described in more detail with reference to FIG. 1.

Figure 1:
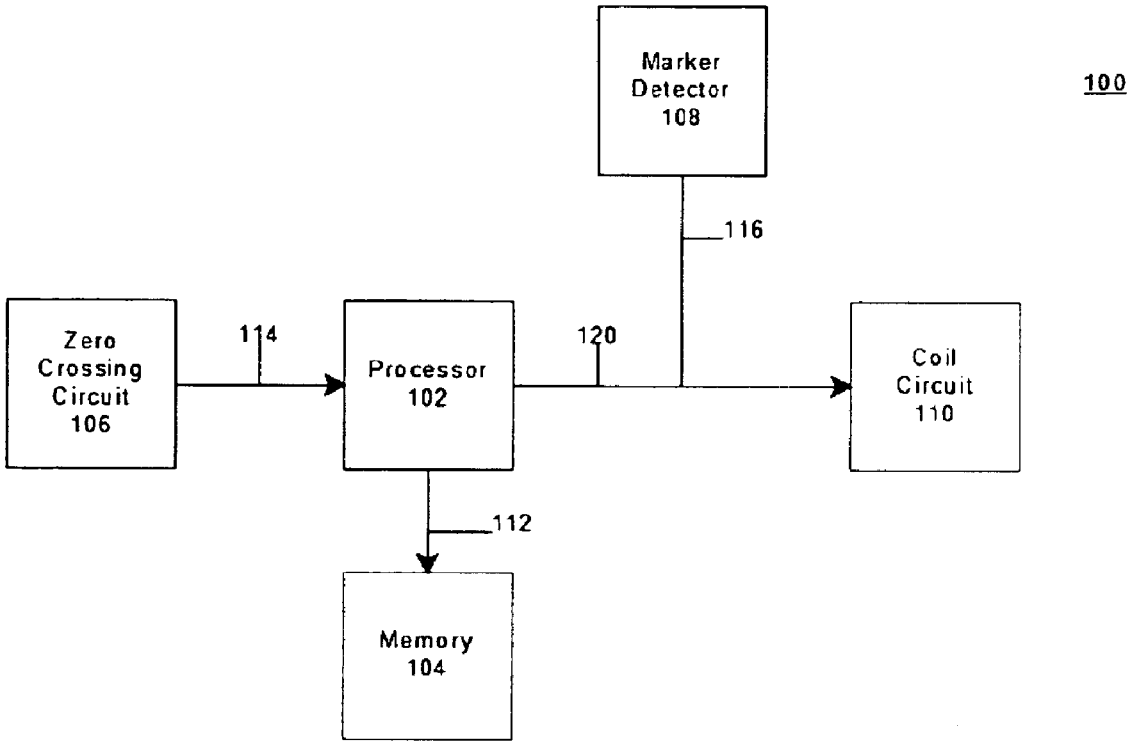
FIG. 1 illustrates a block diagram of a deactivator in accordance with one embodiment.

Referring now in detail to the drawings wherein like parts are designated by like reference numerals throughout, there is illustrated in FIG. 1 a block diagram of a deactivator 100. Deactivator 100 may comprise a plurality of nodes. The term "node" as used herein may refer to an element, module, component, board or device that may process a signal representing information. The term "module" as used herein may refer to one or more circuits, registers, processors, software subroutines, or any combination thereof could be substituted for one, several, or all of the modules. The signal may be, for example, an electrical signal, optical signal, acoustical signal, chemical signal, and so forth.

In one embodiment, deactivator 100 may comprise a zero-crossing circuit 106 connected to a processor 102 via line 114. Processor 102 may be connected to a coil circuit 110 via line 120, and memory 104 via line 112. Marker detector 108 may be connected to coil circuit 110 via line 120. Although a limited number of nodes are shown in FIG. 1, it may be appreciated that the functionality for the various nodes may be implemented using more or less nodes and still fall within the scope of the embodiments.

In one embodiment, deactivator 100 may comprise marker detector 108. Marker detector 108 may comprise transmit/receive coils and associated processing circuitry to detect the presence of an EAS marker for an EAS security tag. Alternatively, marker detector 108 may also be part of coil circuit 110. Once detector 108 detects the presence of an EAS marker, it may send a signal to zero-crossing circuit 106 via line 116 to initiate the deactivation operation to deactivate the EAS marker, thereby rendering it undetectable by the EAS detection equipment when passing through the interrogation zone.

In one embodiment, deactivator 100 may comprise a zero-crossing circuit 106. Zero-crossing detector 106 may monitor an alternating current (AC) input voltage waveform provided to coil circuit 110. Zero-crossing detector 106 may produce a pulse at each transition of the AC input voltage waveform ("zero-crossing"). The transition may be either from positive to negative or from negative to positive. Zero-crossing detector 106 may output a signal comprising a train of pulses via line 114 to processor 102, with each pulse representing a zero-crossing of the AC input voltage waveform.

In one embodiment, deactivator 100 may comprise a processor 102 and memory 104. The type of processor may vary in accordance with any number of factors, such as desired computational rate, power levels, heat tolerances, processing cycle budget, input data rates, output data rates, memory resources, data bus speeds and other performance constraints. For example, the processor may be a general-purpose or dedicated processor, such as a processor made by Intel® Corporation, for example. Processor 102 may execute software. The software may comprise computer program code segments, programming logic, instructions or data. The software may be stored on a medium accessible by a machine, computer or other processing system, such as memory 104. Memory 104 may comprise any computer-readable mediums, such as read-only memory (ROM), random-access memory (RAM), Programmable ROM (PROM), Erasable PROM (EPROM), magnetic disk, optical disk, and so forth. In one embodiment, the medium may store programming instructions in a compressed and/or encrypted format, as well as instructions that may have to be compiled or installed by an installer before being executed by the processor. In another example, the functions performed by processor 102 may also be implemented as dedicated hardware, such as an Application Specific Integrated Circuit (ASIC), Programmable Logic Device (PLD) or Digital Signal Processor (DSP) and accompanying hardware structures. In yet another example, the functions performed by processor 102 may be implemented by any combination of programmed general-purpose computer components and custom hardware components. The embodiments are not limited in this context.

In one embodiment, processor 102 may generate a timing signal to provide timing information to coil circuit 110. In one embodiment, processor 102 may receive the zero-crossing signal from zero-crossing detector 106. Processor 102 may use the zero-crossing signal to determine a reference time. The reference time may comprise the leading edge or falling edge of a pulse in the zero-crossing signal. Processor 102 may use the reference time to interpolate a zero-crossing period for the AC input voltage waveform. For example, the zero-crossing period for an AC input voltage waveform typically used in the United States may correspond to approximately 60 Hertz (Hz). In another example, the zero-crossing period for an AC input voltage waveform typically used in Europe may correspond to approximately 50 Hz. Once processor 102 determines the zero-crossing period, processor 102 may retrieve a dwell time corresponding to the zero-crossing period. The dwell time may be predetermined and stored as part of a timing table in memory 104 and retrieved via line 112. The dwell time may also be calculated by processor 102 during run time using the appropriate equations. Processor 102 may use the retrieved dwell time and zero-crossings to generate a timing signal for coil circuit 110. The dwell time and timing signal may be described in more detail with reference to FIGS. 2–4. Processor 102 may send the timing signal to coil circuit 110 via line 120.

In one embodiment, deactivator 100 may comprise coil circuit 110. Coil circuit 110 may receive the timing signals from processor 102. Coil circuit 110 may energize one or more coils by applying the AC input voltage. The AC input voltage may be removed in accordance with the timing signals. The release of stored energy in the coil may generate a magnetic field having an amplitude profile sufficient to deactivate or render inactive an EAS marker for an EAS security tag. The term "amplitude profile" may refer to the peak amplitudes of a waveform over a given time interval.

In one embodiment, for example, coil circuit 110 may generate a magnetic field having an amplitude profile sufficient to deactivate a "magneto-mechanical" EAS marker. Magneto-mechanical EAS markers may include an active element and a bias element. When the bias element is magnetized in a certain manner, the resulting bias magnetic field applied to the active element causes the active element to be mechanically resonant at a predetermined frequency upon exposure to an interrogation signal which alternates at the predetermined frequency. The EAS detection equipment used with this type of EAS marker generates the interrogation signal and then detects the resonance of the EAS marker induced by the interrogation signal. To deactivate the magneto-mechanical EAS markers, the bias element may be degaussed by exposing the bias element to an alternating magnetic field that has an initial magnitude that is greater than the coercivity of the bias element, and then decays to zero over a time interval. After the bias element is degaussed, the EAS marker's resonant frequency is substantially shifted from the predetermined interrogation signal frequency, and the EAS marker's response to the interrogation signal is at too low an amplitude for detection by the detecting apparatus.

In one embodiment, coil circuit 110 may generate the desired magnetic field while reducing the high voltage capacitor. High voltage capacitors are typically a significant percentage of the deactivator size and cost. Capacitor size and cost is proportional to the capacitance, which is reduced using the techniques described in the various embodiments. Further, high voltage capacitors need time to charge after each use. Typically the charge time may be 0.5 to 1.5 seconds, for example. The charge time may limit the throughput of products having an EAS marker over the device. Throughput may be particularly important in those applications having a low tolerance to latency, such as the food service industry, for example. The embodiments may reduce the charge time for the capacitor to approximately 7 milliseconds (ms). By reducing the size of the high voltage capacitor, deactivator 100 may be smaller and less expensive then conventional deactivators, and may also increase throughput of security tags through deactivator 100.

Figure 2:
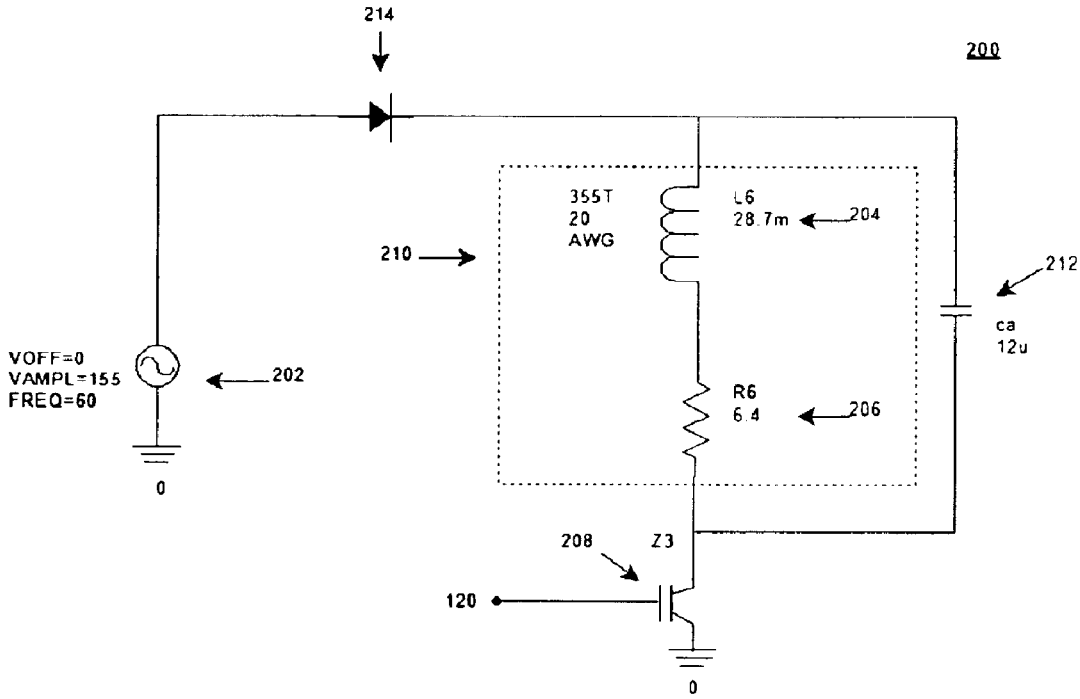
FIG. 2 illustrates a block diagram of a coil circuit in accordance with one embodiment.

FIG. 2 illustrates a block diagram of a coil circuit in accordance with one embodiment. FIG. 2 illustrates a coil circuit 200. Coil circuit 200 may be representative of, for example, coil circuit 110. In one embodiment, coil circuit 200 may comprise a parallel LR-C circuit that is tied on one side to an AC line voltage source 202, and on the other side to a high voltage low side electronic power switch 208. The AC line voltage source 202 may provide a 110 or 220 volt 60 Hz power supply as provided by a power company, for example. The AC input voltage may be rectified by rectifier 214 prior to being applied to coil 210. An example of switch 208 may comprise an insulated gate bipolar transistor (IGBT) switch. An inductive EAS antenna such as coil 210 may be positioned between AC voltage source 202 and switch 208. Coil 210 may comprise, for example, an inductor 204 and a resistor 206, with resistor 206 being parasitic. Coil 210 may be in parallel with a high voltage capacitor 212.

In one embodiment, a magnetic field may be generated by coil 210 when switch 208 is closed. Rectifier 214 may be full or half-bridge that converts the AC input voltage to DC input voltage, thereby ensuring that coil 210 only generates a positive magnetic field which is incapable of deactivating an EAS marker. The coil current for coil 210 is allowed to dwell until a peak coil current is reached. At peak coil current, switch 208 may open coil 210 from ground. This interruption releases the stored energy in the magnetic field of coil 210 that in turn causes an AC current to oscillate between coil 210 and capacitor 212. The exponentially decaying AC current waveform in coil 210 generates a magnetic field in proximity to coil 210. The magnetic field may decay in accordance with an amplitude profile to deactivate an EAS marker.

In one embodiment, processor 102 may generate the timing signal using a dwell time and zero-crossing information generated by zero-crossing detector 106. The dwell time may represent a time interval from a zero-crossing of a rectified AC input voltage (i.e., DC input voltage) to a peak coil current. Switch 208 may be closed at a precise dwell time (angle) relative to the zero-crossing for the DC input voltage waveform to start the dwell cycle. The dwell time continues until the peak current in the coil is reached. It is worthy to note that the peak coil current is not necessarily at the peak of the DC input voltage waveform because of phase shifting. Therefore, the peak coil current may be predetermined for a given zero-crossing period and stored in the timing table, or determined during processor run-time. The relationship between the dwell time and coil current may be further described with reference to FIGS. 3 and 4.

Figure 3:
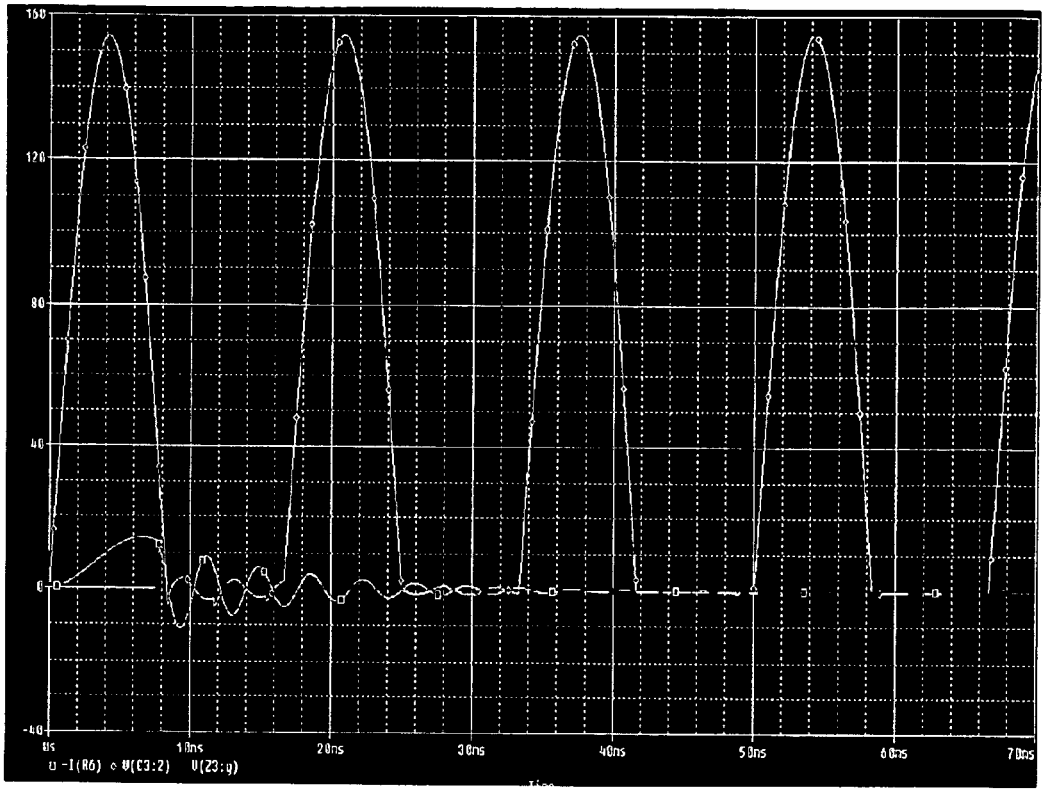
FIG. 3 illustrates a graph showing a rectified alternating current (AC) waveform and an amplitude profile for a coil current to deactivate an EAS marker in accordance with one embodiment.

FIG. 3 illustrates a graph showing a rectified AC waveform and an amplitude profile for a coil current to deactivate an EAS marker in accordance with one embodiment. As stated previously, switch 208 may be opened or turned off at the end of the dwell time as indicated by the timing signal from processor 102. The total stored energy in the magnetic field of coil 210 at the end of the dwell cycle is maximized and represented by the equation $\frac{1}{2} Li^2$, where L is the inductance of the coil in milliHenrys (mH) and i is the peak current through the coil in Amperes (Amps). The AC current then continues by oscillating between the parallel capacitor 212 and coil 210 in a damped harmonic oscillation. The damped harmonic oscillation may be shown in FIGS. 3 and 4. The particular coil and capacitor for a given implementation may be chosen to produce an under damped transient. This damped ring down in the coil current produces a magnetic field of the appropriate amplitude profile to deactivate an EAS marker brought in close proximity to coil 210.

Figure 4:
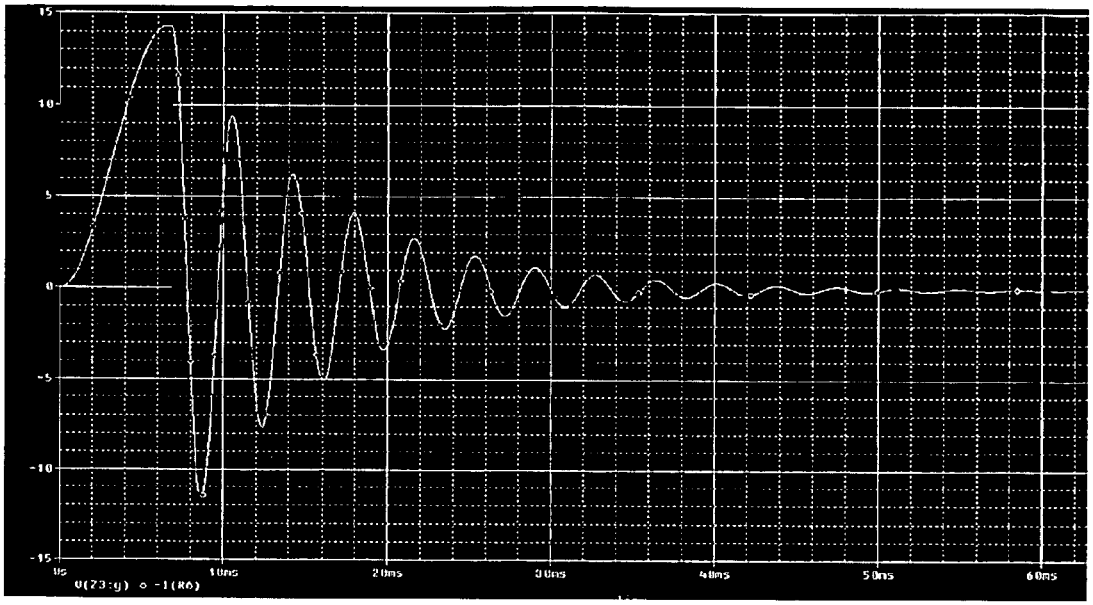
FIG. 4 illustrates a more detailed amplitude profile for a coil current to deactivate an EAS marker in accordance with one embodiment.

FIG. 4 illustrates a more detailed amplitude profile for a coil current to deactivate an EAS marker in accordance with one embodiment. As shown in FIG. 4, the dwell time from an AC zero-crossing is approximately 7 ms in this example. During the dwell time, the coil current reaches a peak of approximately 14 Amps. Once switch 208 is opened or turned off in accordance with the timing signal from processor 102, capacitor 212 in parallel to coil 210 acts a second order system which begins to oscillate. The result is an exponentially decaying AC current waveform that reduces in peak amplitude each cycle until the AC current waveform decays to zero at approximately 58 ms.

The current waveform starts with IGBT switch 208 conducting the AC input voltage applied to coil 210. When the coil current reaches a peak, IGBT switch 208 may be opened, thereby releasing the potential energy in the magnetic field of coil 210 into kinetic energy to create an exponentially decaying AC current waveform. The exponentially decaying waveform may be sufficient to produce an alternating magnetic field to deactivate the EAS marker for EAS security tags brought in close proximity to coil 210. The magnetic field is generated by the product of the number of coil turns times the coil current (NI). It is worthy to note that by reducing the coil current by a factor of approximately 10–20, and increasing the number of coil turns by the same factor, the magneto motive force (mmf) remains approximately constant.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments of the invention.

What is claimed is:

1. A method comprising:

applying a rectified alternating current (AC) input voltage to a coil in parallel to a high voltage capacitor;

generating a first signal to represent zero-crossings for said AC input voltage;

determining a zero-crossing period using said first signal;

retrieving a dwell time using said zero-crossing period;

generating a second signal using said first signal and said dwell time; and creating a magnetic field using said coil and high voltage capacitor to deactivate an electronic article surveillance (EAS) in accordance with said second signal.

2. The method of claim 1, wherein said dwell time represents a time interval from a zero-crossing of said AC input voltage to a peak coil current.

3. The method of claim 1, wherein said generating comprises:

retrieving a zero-crossing from said first signal;

measuring a time interval between said zero-crossing and said dwell time; and generating said second signal to indicate an end of said time interval.

4. The method of claim 1, wherein said creating comprises removing said rectified AC input voltage from said coil in accordance with said second signal to cause an AC current to oscillate between said coil and said high voltage capacitor.

5. The method of claim 1, wherein said oscillation creates a decaying AC current waveform having an amplitude profile sufficient to deactivate said EAS marker.

6. The method of claim 5, wherein said AC current waveform decreases in amplitude over said time interval in accordance with said amplitude profile.

7. The method of claim 3, wherein said decrease in amplitude is exponential.

8. The method of claim 1, further comprising:

detecting said EAS marker; and sending a detection signal to a zero-crossing detector.

9. An apparatus, comprising:

a zero-crossing circuit to detect zero-crossings of an alternating current (AC) input voltage waveform, and generate a first signal to represent said zero-crossings;

a processor to connect to said zero-crossing circuit, said processor to receive said first signal and retrieve a dwell time based on said first signal, and to generate a second signal using said first signal and said dwell time; and a coil circuit to connect to said processor, said coil circuit to receive said second signal and create a magnetic field to deactivate an electronic article surveillance (EAS) marker.

10. The apparatus of claim 9, wherein said coil circuit comprises:

an AC voltage source to generate said AC input voltage;

a rectifier to couple to said AC voltage source and convert said AC input voltage to a direct current (DC) input voltage;

a coil to couple to said rectifier;

a high voltage capacitor in parallel with said coil; and a switch to couple to said coil and receive said second signal, said switch to remove said DC input voltage from said coil in response to said second signal.

11. The apparatus of claim 10, wherein said switch is an insulated gate bipolar transistor (IGBT) switch.

12. The apparatus of claim 11, wherein said IGBT switch is closed to apply said DC input voltage to said coil, and said IGBT switch is opened to remove said DC input voltage from said coil.

13. The apparatus of claim 12, wherein said removing said DC input voltage from said coil in accordance with said second signal causes an AC current to oscillate between said coil and said high voltage capacitor.

14. The apparatus of claim 9, wherein said processor determines a zero-crossing period based on said first signal and uses said zero-crossing period to retrieve said dwell time, with said dwell time to represent a time interval from a zero-crossing of said DC input voltage to a peak coil current.

15. The apparatus of claim 10, wherein said coil comprises an inductor and a parasitic resistor.

16. The apparatus of claim 9, wherein said magnetic field decays over time in accordance with an amplitude profile.

17. The apparatus of claim 16, wherein said decaying magnetic field is proportional to a number of turns in said coil times a peak coil current.

18. The apparatus of claim 9, further comprising a marker detector to detect said EAS marker.

19. An article comprising:

a storage medium;

said storage medium including stored instructions that, when executed by a processor, result in determining a zero-crossing period using a first signal to represent zero-crossings from an alternating current (AC) input voltage waveform, retrieving a dwell time using said zero-crossing period, generating a second signal using said first signal and said dwell period, and sending said second signal to a coil circuit to create a magnetic field to deactivate an electronic article surveillance (EAS) marker.

20. The article of claim 19, wherein the stored instructions, when executed by a processor, further result in said generating by retrieving a zero-crossing time from said first signal, measuring a time interval between said zero-crossing time and said dwell time, and generating said second signal to indicate an end of said time interval.

21. An electronic article surveillance deactivator, comprising:

a zero-crossing circuit to detect zero-crossings of an alternating current (AC) input voltage waveform, and generate a first signal to represent said zero-crossings;

a processor to retrieve a dwell time, and generate a second signal using said first signal and said dwell time; and a coil circuit to use said second signal to deactivate an electronic article surveillance (EAS) marker using inductive discharge of said AC input voltage.

22. The deactivator of claim 21, wherein said coil circuit comprises:

an AC voltage source to generate said AC input voltage;

a rectifier to couple to said AC voltage source and convert said AC input voltage to a direct current (DC) input voltage;

a coil to couple to said rectifier;

a high voltage capacitor in parallel with said coil; and a switch to couple to said coil and receive said second signal, said switch to remove said DC input voltage from said coil in response to said second signal.

23. The apparatus of claim 21, further comprising a marker detector to detect said EAS marker.

* * * * *